United States Patent [19]

Steffensen et al.

[11] 4,179,820

[45] Dec. 25, 1979

[54] APPARATUS FOR DRYING VENEER

[75] Inventors: Leslie M. Steffensen, Springfield; H. Gary Dutell, Eugene; Robert A. Rydell, Corvallis, all of Oreg.

[73] Assignee: Georgia-Pacific Corporation, Portland, Oreg.

[21] Appl. No.: 969,499

[22] Filed: Dec. 14, 1978

Related U.S. Application Data

[62] Division of Ser. No. 787,535, Apr. 14, 1977, Pat. No. 4,146,973.

[51] Int. Cl.[2] ..... F26B 13/30

[52] U.S. Cl. ..... 34/92; 34/242

[58] Field of Search ..... 34/4, 16, 16.5, 92, 34/242

[56] References Cited

U.S. PATENT DOCUMENTS

| | | | |
|---|---|---|---|
| 3,271,874 | 9/1966 | Oppenheimer | 34/39 X |
| 3,289,315 | 12/1966 | Smith, Jr. | 34/92 |
| 3,467,399 | 9/1969 | Kelly et al. | 34/242 |
| 3,474,544 | 10/1969 | Holden, Jr. et al. | 34/18 |
| 4,127,946 | 12/1978 | Buchholz | 34/16.5 |

*Primary Examiner*—John J. Camby

*Attorney, Agent, or Firm*—Schuyler, Birch, McKie & Beckett

[57] ABSTRACT

The method comprises feeding the veneer through a closed chamber under vacuum conditions, and heating the veneer while in the chamber by an infrared emitter. The apparatus comprises a chamber having means for feeding the veneer to, through and from the chamber, means for creating a vacuum within the chamber, and infrared emitter heating means.

23 Claims, 9 Drawing Figures

FIG. 8
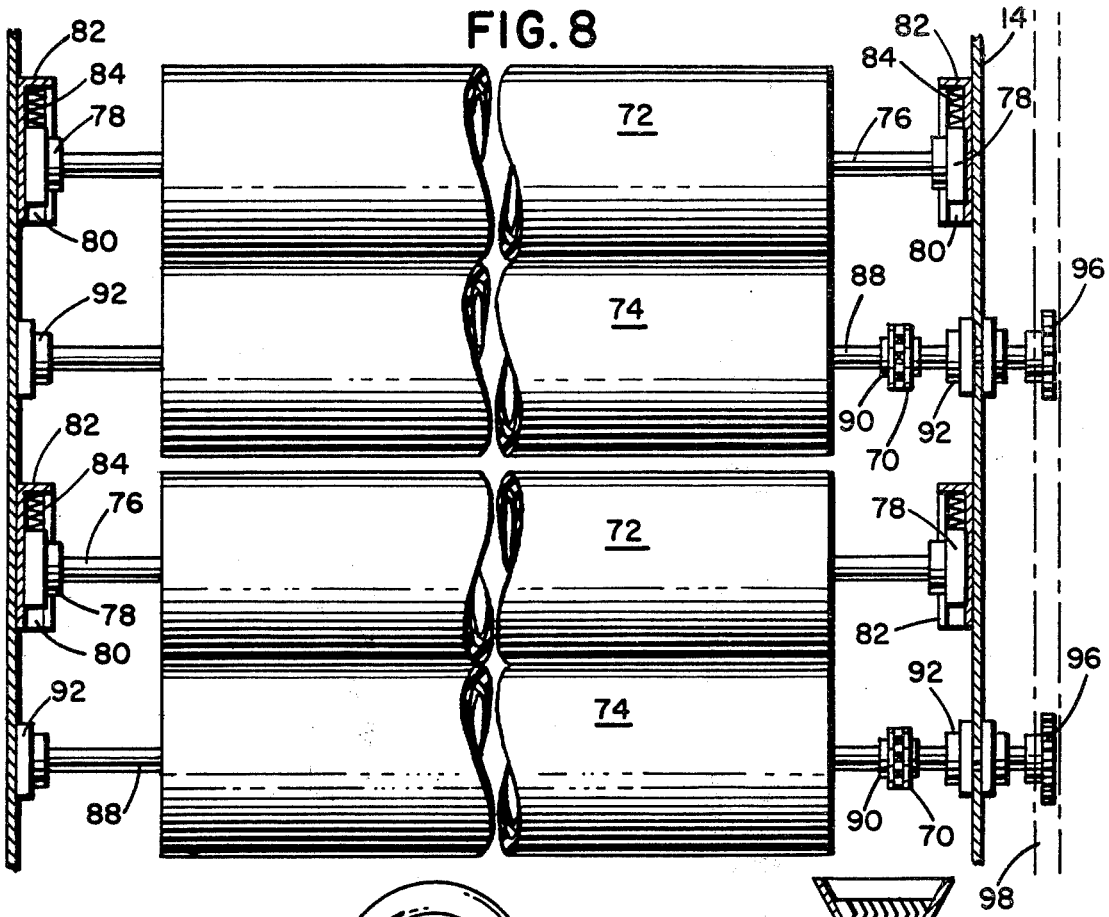
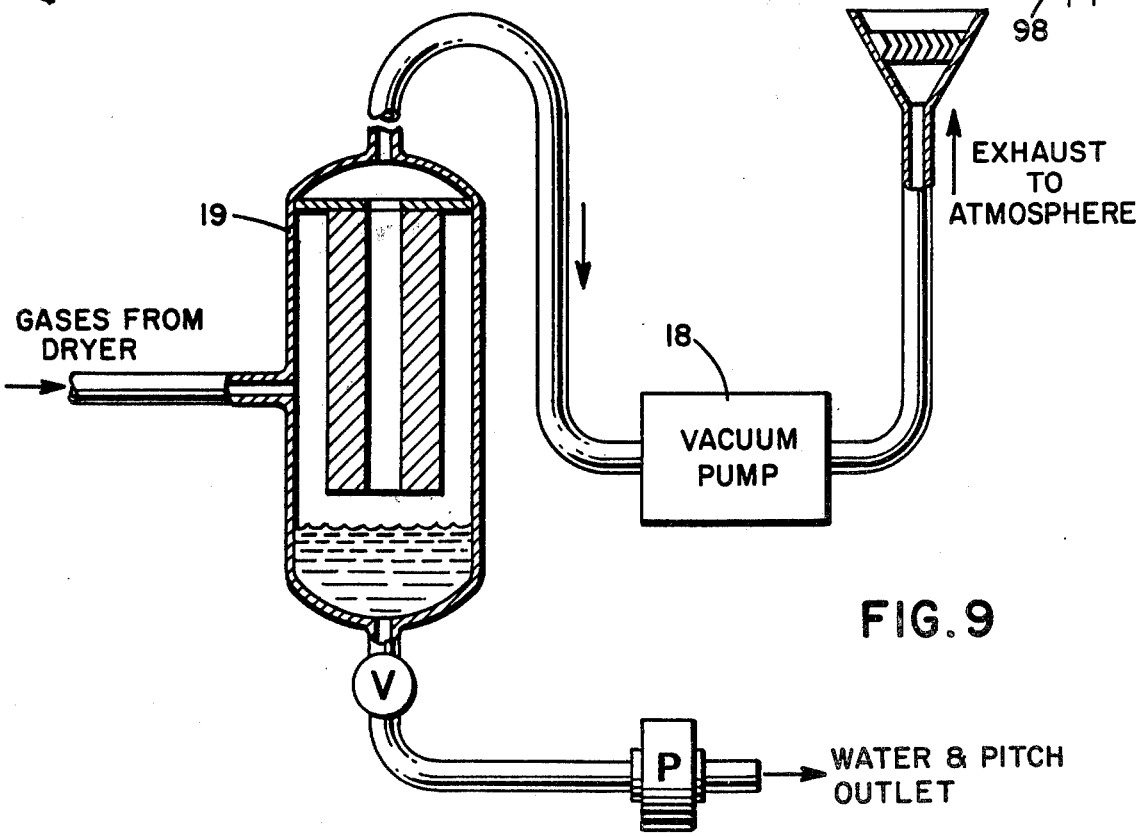
FIG. 9

APPARATUS FOR DRYING VENEER

This application is a division of our copending application Ser. No. 787,535 filed Apr. 14, 1977 now U.S. Pat. No. 4,146,973.

BACKGROUND OF THE INVENTION

One of the most troublesome steps in the manufacture of wood veneers, and other items of like physical characteristics, is that of drying the item. To have a commercially feasible method and apparatus, drying must be accomplished quickly and economically, and with minimal risk of damage. In the prior art, these three objectives have not coincidentally been attainable.

Checking, scorching and lowering of fiber strength are three results of improper drying that cause damage to the item being dried. Checking is the presence of cracks in the fissures of the dry wood. It is principally caused by removing water so rapidly from the outermost layers that they undergo physical contraction that sets up uneven stresses in those layers. This condition often occurs when wood is dried by direct hot air means. Scorching is caused when high surface temperatures, such as at above 270° F. at atmospheric pressure, are created on the material being dried in an effort to promote quick water removal. This is particularly troublesome when using infrared heating at high temperatures. Scorch is not usually present when drying is done by steaming, but the steaming process has its own problems, one of which is the possibility of lowering the fiber strength, due to hydrolyzing action of the moisture.

Air drying is a well known method of drying woods. It is accomplished by simply allowing the wood to rest in atmospheric conditions, or by blowing heated air over it. However, air drying is a very slow process when done under atmospheric conditions. Forced or heated air drying is also faster, but the temperatures must be controlled to prevent case hardening. It requires a significant level of energy over a long period of time. Steam drying is faster than air drying under normal conditions, and requires a higher level of energy input.

Some prior art methods have included either or both of the above concepts carried out under vacuum conditions, for various reasons, all said to enhance their operation. These have been batch processes, not designed for the continuous flow processing that is necessary when drying veneers under commercial circumstances.

Various sources of heat have also been used in the prior art. Air or steam is heated by various means and circulated over the wood in some of the systems. In others, the wood is placed in contact with a heated body, or the chamber is heated from inside or outside. Instances of heating by infrared energy are also present in the prior art, but not in veneer dryers or the like.

BRIEF DESCRIPTION OF THE INVENTION

The overall object of this invention is to dry wood veneer and the like quickly, effectively and efficiently.

Another object of the invention is to dry wood veneer and the like by means of infrared energy.

Another object of this invention is to provide a continuously operating method and apparatus to dry wood veneer and the like.

Still another object of this invention is to dry wood veneer and the like relatively low surface temperatures.

In accordance with the method of this invention, wood veneer or material that can be dried under similar circumstances is placed in a chamber that can be sealed to allow a vacuum to be established therein. The veneer is exposed, under vacuum conditions, to radiant energy sources that emit a relatively high level of infrared energy. It has been found that infrared energy is particularly well suited for drying veneer. The water in the wood is vaporized during this process and the drying is accomplished, of course, by the removal of the vaporized water from the veneer. When drying is accomplished under atmospheric conditions, water vaporizes at about 212° F., which means that the surface temperature of the veneer will be higher, after the water is removed, moving dangerously close to or beyond the 270° F. surface temperature at which damage to the veneer can occur. In the inventive method, the drying takes place in a vacuum of about 20 inches of Mercury, for example, at which the boiling point of water lowers to about 160° F. The surface temperature of the veneer is then well below the danger point. Under the vacuum conditions, the driving force for water removal remains the same at 160° F. as it would be at 212° F. under atmospheric conditions. The process is also enhanced by the fact that infrared energy passes through a space under vacuum conditions with negligible energy loss, unlike other forms of heat energy. Therefore, the gain in drying under reduced pressure is not lost by the inefficiency of heat transfer in a vacuum.

The invention contemplates a continuous flow of veneer or other material into the drying chamber, in a plurality of layers separated from one another. Also contemplated is a separator step for removing water and pitch from the gases going to the vacuum pump.

A preheating step can also be used. In such a step, the veneer is heated by gas infrared heaters or the like under atmospheric conditions. Some heat is conducted into the wood, but the surface temperature of the wood is kept low, to a level of 80°–130° F. For example, the veneer sheets may be preheated to an average surface temperature of about 110° F. Then, the veneer is fed into the vacuum chamber.

An apparatus constructed in accordance with the invention allows existing equipment to be modified for vacuum infrared drying. It comprises a chamber having feed means, such as roller conveyors, for moving veneer through in several decks, separated from one another. In order to allow vacuum conditions to exist in the chamber, pairs of powered sealing and feeding rolls are provided, between which the veneer is moved. A vacuum pump is connected to the chamber to lower the pressure, and a separator for removing condensed water and pitch is interposed in the line between the vacuum pump and the chamber. Long wave length infrared emitters are located above and below the path of movement of the veneer through the conveyor. These should be "black body" sources, heated by steam, electricity, or gas, that gives off long wave radiation in the infrared spectrum.

The use of energy in the infrared spectrum offers several advantages over systems used in the prior art. First, the travel of infrared energy is not affected by vacuum conditions, as is the travel of other normal convected energy. Second, it has been found that the infrared energy will dry wood and the like materials faster than other types such as convection drying because of the ability of wet materials such as wood to absorb this infrared energy into the body of the material, rather than just on the surface. Third, the surface of the material does not develop a boundary layer of saturated vapor which deters the evaporation of water from the surface of the material. Fourth, the energy requirements for the infrared system are less than those of prior art systems, yielding a better overall system efficiency.

Other objects and advantages of this invention will become apparent from the description of the preferred embodiment.

BRIEF DESCRIPTION OF THE DRAWINGS

FIG. 8 is a front view of the cooperating pairs of conveying rollers of two adjacent sets of conveying rollers.

FIG. 9 is a side view, partially in section, of a vapor separation and vacuum pump connected to the drying chamber.

DESCRIPTION OF A PREFERRED EMBODIMENT

This invention is described and shown to best advantage when considered in the context of the drying of wood veneers. However, it can be used for drying other items having similar drying problems and characteristics.

Figure 1:
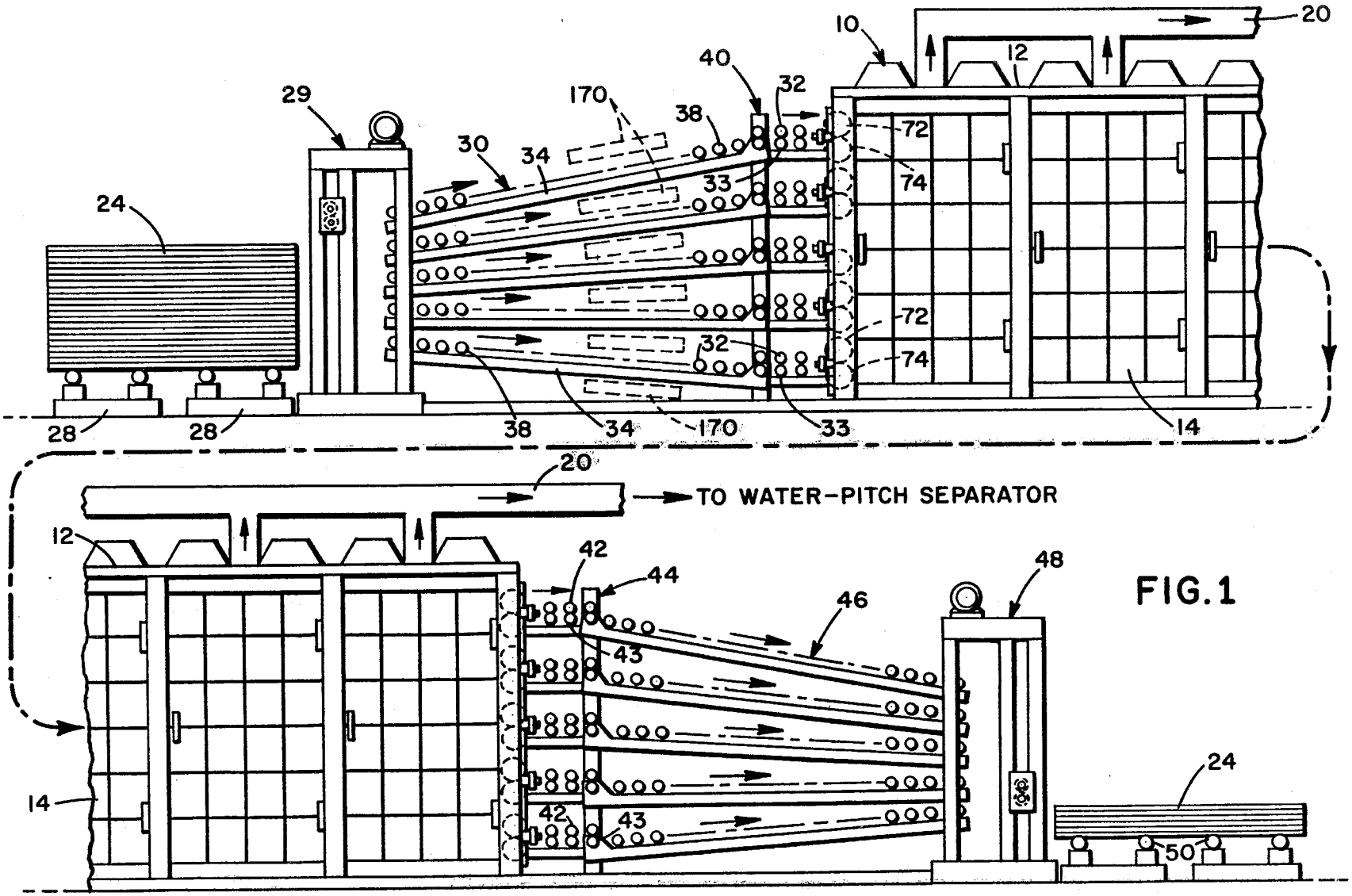
FIG. 1 is a side view of a conventional veneer drying apparatus constructed and modified in accordance with the teachings of this invention.

FIG. 1 shows an overall view of the inventive apparatus, the main element of which is a drying chamber 10. Since chamber 10 is placed under a vacuum, roof 12 and doors and walls 14 are of sufficient strength to stand in the face of higher outside pressure. The chamber is placed in communication with a vacuum pump 18 (FIG. 9) by means of a duct system 20.

The dryer as seen from FIG. 1 is of the conventional multiple deck type, having a plurality of levels upon which veneer is dryed. Near the entrance end of the chamber is the veneer feed mechanism. A stack of sheets of veneer 24 rests upon stack rollers 26 which are supported on platforms 28. A sheet unstacking mechanism is shown at 29. This can be one of many well known types, and comprises means for removing the top sheet of veneer 24 from the stack and feeding it to one of the five input feed conveyors 30, which pass the sheet to several pairs of opposed input feed rolls 32 and 33. Input feed conveyors 30 are not shown in detail, but each comprises basically a frame 34 upon which are mounted a plurality of driven rollers 38. The opposed pairs of feed rolls 32,33 are mounted on a frame 40. The details of these various input mechanisms are well known to one skilled in the art, so detailed explanations are not considered to be necessary.

The output feed mechanisms illustrated in FIG. 1 are virtually the same as the input feed mechanisms, comprising a plurality of pairs of output feed rollers 42, 43 mounted on a frame 44 immediately adjacent to the chamber exit, a plurality of output feed conveyors 46 and a sheet placement mechanism 48 that stacks the dried sheets of veneer 24 upon a stack roller 50.

Figure 2:
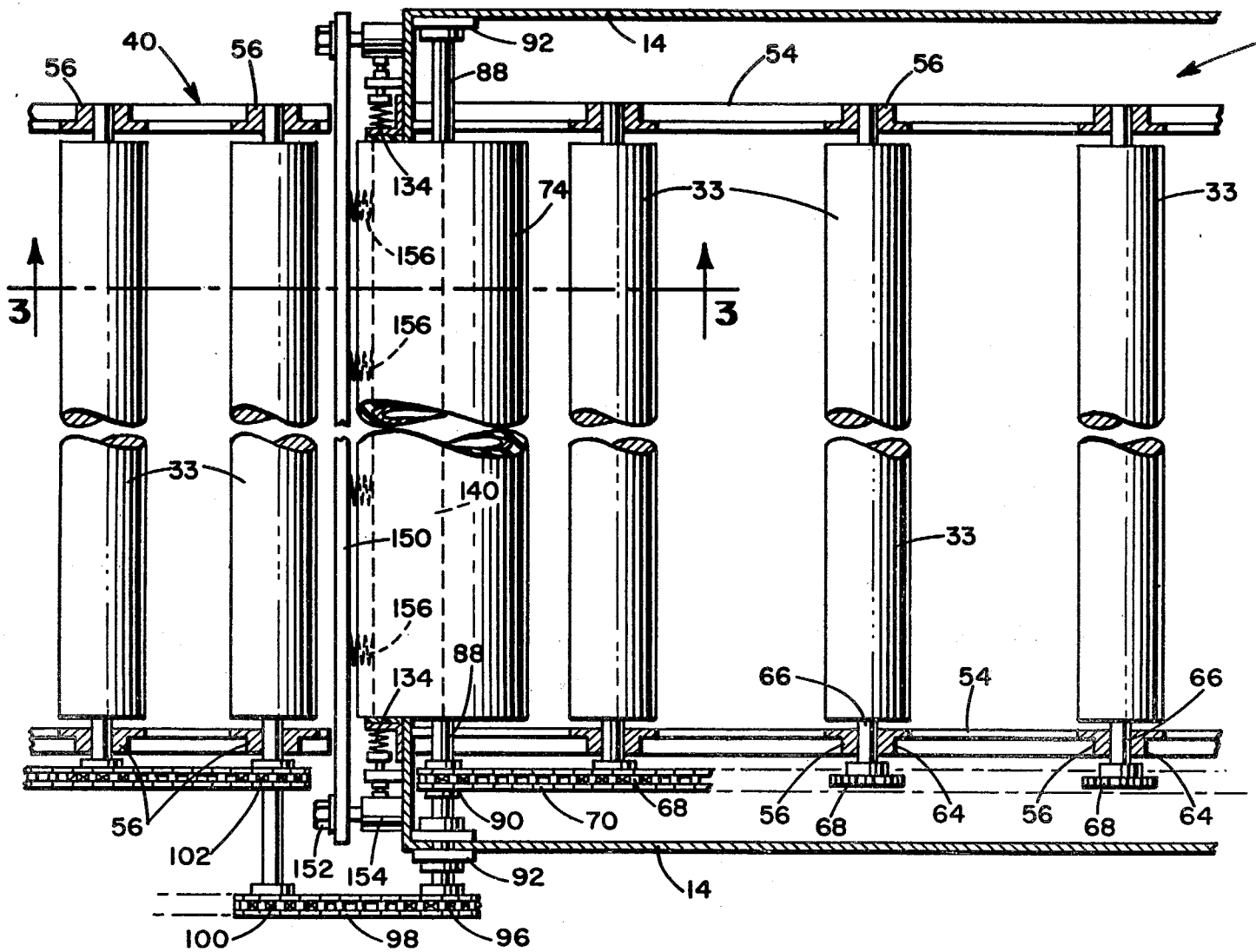
FIG. 2 is a top view of the vacuum chamber entry portion of the apparatus shown in FIG. 1, with the roof of the chamber and the upper set of conveying rollers of the top conveyor removed.
Figure 3:
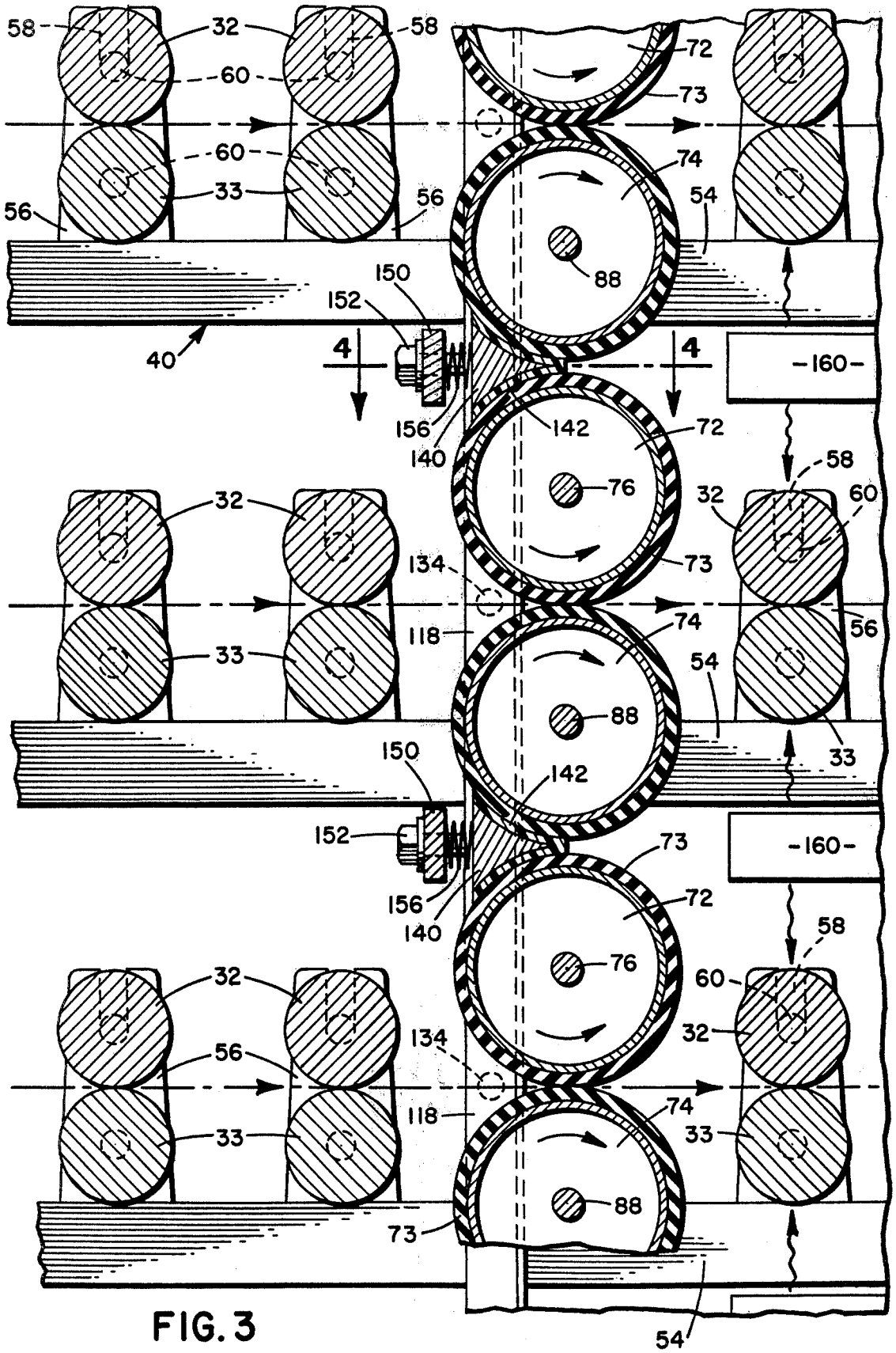
FIG. 3 is a sectional view taken along line 3—3 of FIG. 2, showing the chamber entry portion and several sets of conveying rollers and entry air seal rollers.

The conveying of the sheets 24 through chamber 10 is accomplished by a plurality of identical conveyor decks, seen most clearly in FIGS. 2 and 3, whereby the capacity of the system is increased. All of the conveyor decks are identical. Each conveyor deck comprises a deck frame 54, that carries a plurality of opposed pairs of upstanding roller support brackets 56. Outside entry support frame 40, and its twin at the exit, are actually extensions of the deck frames 54, and carry support brackets 56 also. Each bracket 56 comprises a recess 58, into which the shaft 60 of the upper rolls 32 are received. Rolls 32 are not driven and are biased toward rolls 33 by their weight. Rolls 32 can move upwardly to allow a sheet 24 to enter the nip, and then they press sheet 24 against the driven rolls 33 with sufficient force to insure continual driving engagement to move the sheets. Each bracket 56 also has a journal bearing 64 to support one end of a shaft 66 upon which each roll 33 is mounted. Shaft 66 extends through bracket 56 on at least one side, and there carries a drive gear 68, driven by a chain 70, causing rolls 33 to rotate. A suitable motor, not shown, drives the chains 70.

Chambers 10 operates under vacuum conditions, and therefore special considerations regarding sealing must be given to the entrance and exit of the veneer sheets. The veneer sheets 24 enter (and exit) chamber 10 by moving between an upper sealing roll 72 and a lower sealing roll 74, each end of which is received in a bearing 78 mounted in a slot 80 of bearing support 82 as seen most clearly in FIGS. 4 and 5. A spring 84 mounted in slot 80 urges sealing roll 72 downwardly into engagement with sealing roll 74, yet allows movement apart from sealing roll 74 for the passing of veneer sheets 24. Lower sealing roller 74 is mounted on a shaft 88, which is equipped as shown in FIG. 2, with a drive sprocket 90 engaged by chain 70. The ends of shaft 88 are received in fixed bearings 92, which pass through the wall 14 of chamber 10. On the outside of the chamber, shaft 88 has a second sprocket 96, around which passes a chain 98 (FIG. 2). Entrance (and exit) rolls 33 are driven via chain 98 and sprockets 100 and 102, suitably connected to the mounting shafts of rolls 33. Bearing 92 must not permit air to leak into chamber 10.

Figure 4:
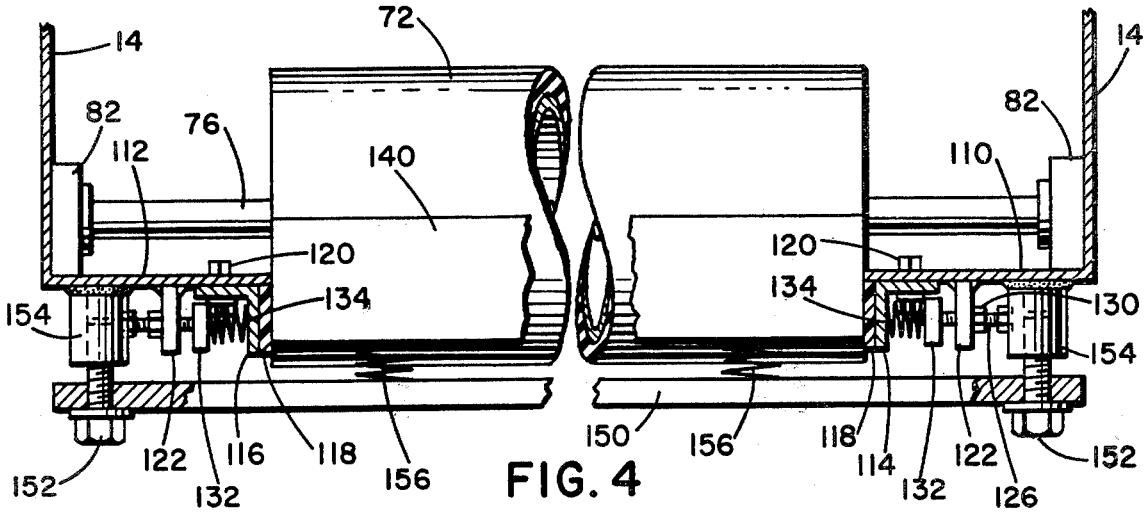
FIG. 4 is a view taken along line 4—4 of FIG. 3.
Figure 5:
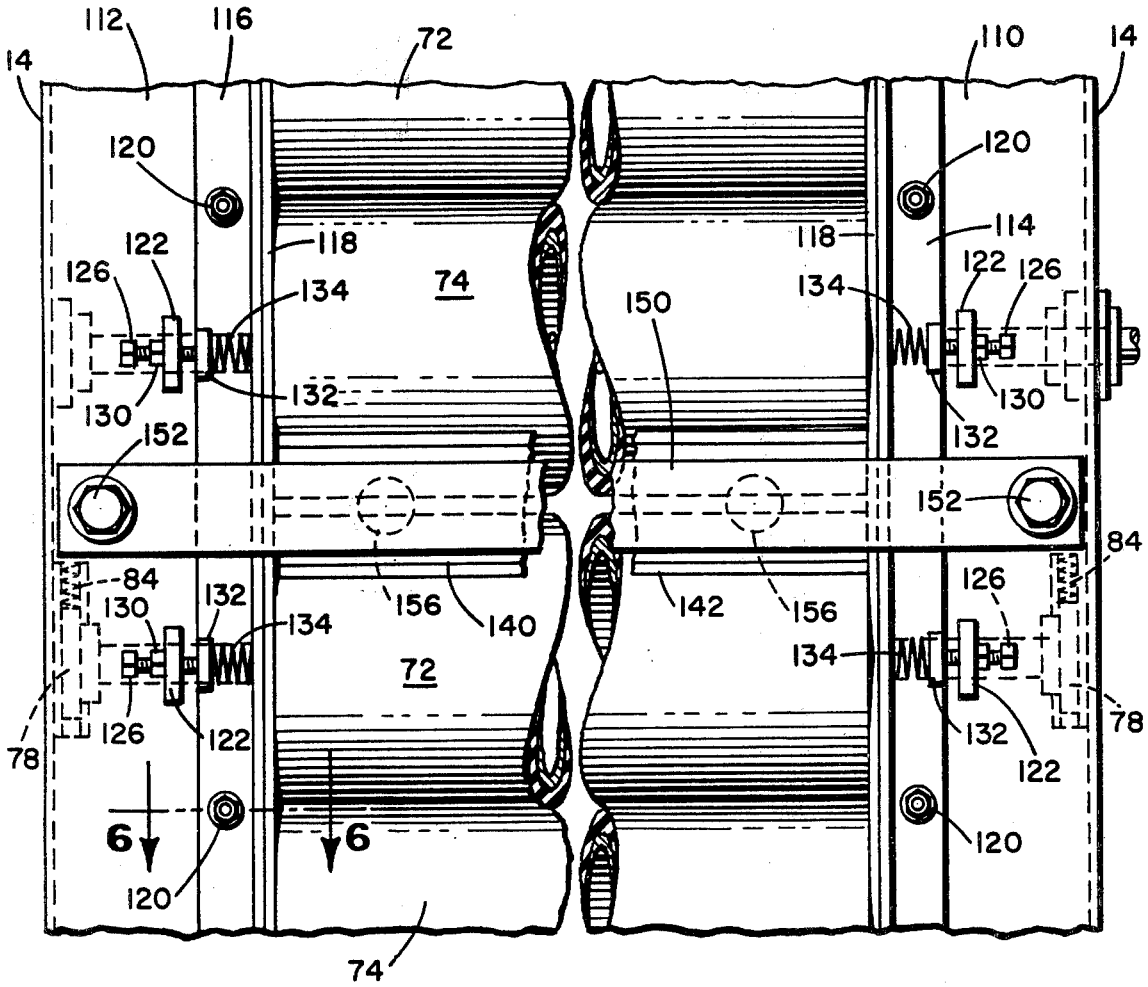
FIG. 5 is a front view of the relationship between the lower and upper sealing rolls of two adjacent sets of conveying rollers.

The width of sealing rolls 72 and 74 shown in FIGS. 4 and 5, corresponds substantially to the width of the veneer sheets 24. Rolls 72 and 74 are flanked by chamber end plates 110 and 112. A pair of air seal flanges 114 and 116, each having a resilient sealing pad 118 so located as to be pressed against the sides of sealing rolls 72 and 74, are attached to end plates 110 and 112 by bolts 120, which are not tightly fastened. A plurality of brackets 122, located on either side of sealing rolls 72 and 74 support a screw threaded shaft 126, upon which is a pair of lock nuts 130, 131 and spring plate 132. Interposed between spring plate 132 and flanges 114 and 116 is a spring 134, which urges the flanges toward the sides of rolls 72 and 74, thus preventing or at least minimizing air leakage into the chamber at this point.

The possibility of air entering the chamber through the nip between sealing rolls 72 and 74 is minimized by their close fit and the spring loading of roll 72, and the resilient surface 73 on the rolls themselves, whether or not a sheet of veneer is passing therebetween. However, since the chamber is equipped with multiple deck, leakage must also be prevented through the ends between the lower roll of a first pair of sealing rolls and the upper roll of a second pair of sealing rolls. This is accomplished by means of a wedge-shaped end seal 140 (See FIG. 3) that is covered with a semi-resilient sealing layer 142 which engages the peripheral surface of the two adjacent sealing rollers. The covering material must promote good sealing, while still not creating excessive frictional drag on sealing rollers 72 and 74. Each end seal 142 is supported by an end bar 150 (FIG. 4) attached by bolts 152 to a tapped projection 154 attached to end panels 110 and 112. A pair of springs 156 connect the end seal 140 to bar 150, thus urging seal 140 inwardly. Since the chamber is under a vacuum, all seals are also urged inwardly by the higher pressure existing outside of the chamber.

Figure 7:
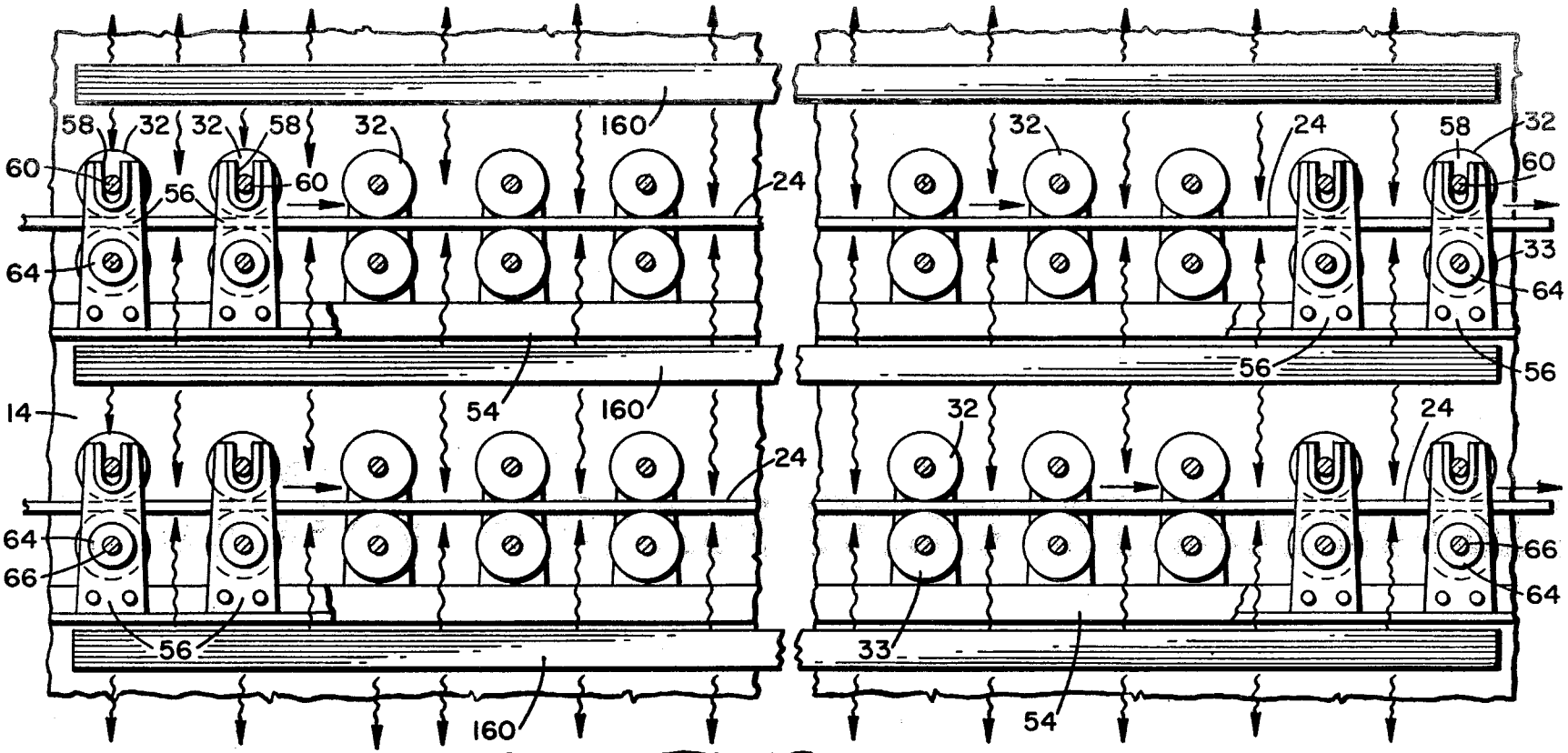
FIG. 7 is a side view of two adjacent sets of conveying rollers, showing sheets being conveyed through the drying chambers while being exposed to infrared radiation.
Figure 6:
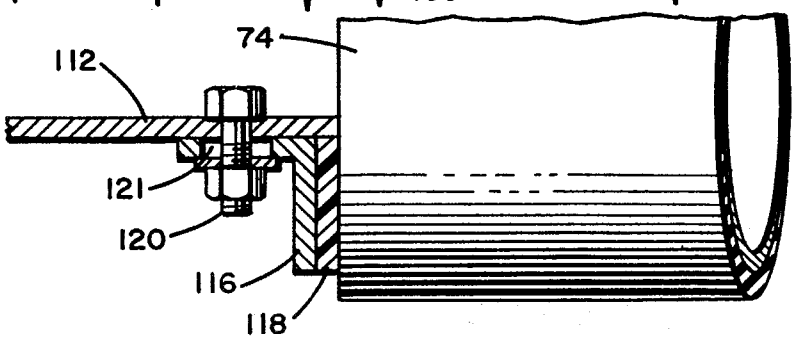
FIG. 6 is a sectional view taken along line 6—6 of FIG. 5.

Infrared radiation is provided throughout the length of chamber 10 by a plurality of emitting bodies 160 best seen in FIG. 7, which are located above and below each of the plural veneer conveying decks. These emitters can be "black bodies" or other devices capable of emitting acceptably infrared radiation wave lengths. They can be fueled by electricity, gas, steam or other appropriate fuels. Emitters 160 are supported by suitable brackets or the like, attached to appropriate structure within the chamber. Since the conveying rollers 72, 74 support sheets 24 away from the chamber structure, substantially the entire upper and lower surfaces of sheets 24 are exposed to the infrared radiation, and thus this energy is efficiently applied to the sheets.

Referring to FIG. 1, a plurality of preheaters 170 can be placed adjacent to feed conveyors 30 to preheat the veneer to a predetermined level prior to entry into chamber 10. These preheaters can be infrared emitters or other types. To increase efficiency, a full or partial enclosure can be placed about conveyor 30.

In standard operation, sheets 24 are fed continuously and cyclically by selection mechanism 29 onto the several input conveyors 34. This standard mechanism keeps all of the decks in chamber 10 full, to maximize the efficiency of the process. Sensors can be placed at various points along the paths of the veneer through the apparatus, so as to maximize the efficiency of the device. In like fashion, the unlocking selector mechanism 48 continuously and cyclically removes the dried sheets from the chamber, and places them in a stack. The infrared emitters are controlled by manual or automatic mechanisms (not shown) so that the desired surface temperature is maintained on the sheets being dried. The vacuum conditions can also be monitored and controlled manually or automatically to maintain the desired pressure conditions in the chamber. Control mechanisms for accomplishing this are well known, and are not shown.

The inventive method comprises the basic steps of establishing a vacuum condition, continuously passing sheets of veneer through the vacuum, and exposing the sheets while in the vacuum to infrared radiation to dry the sheets. Advantageously, the vacuum established is about 20 inches of Mercury, and the amount of infrared radiation is such that the surface temperature of the sheets is about 160° F. during the time when water is being evaporated. This is accomplished by using emmiters with a surface temperature of about 400°-1000° F. and a space temperature in the dryer of from 250°-300° F. It is also advantageous to remove any materials suspended in the air being exhausted by the vacuum. An additional step included in the method is the preheating of the sheets prior to their exposure to vacuum and infrared radiation.

The advantages of the above described method and apparatus over those of the prior art presently used to dry wood veneers are striking. Present prior art forced heated air dryers will dry a typical sheet of 3/16 inch veneer in thirteen minutes. The inventive system, without preheating, will dry the same sheet in seven minutes. This is a 45% increase in productivity. In addition, the total energy requirements of the inventive system are less than those of the air drying system, amounting to a savings of about 25%. Therefore, the inventive system will operate at an energy level of about 40% of the air dryers, for the same throughput of veneer. When the preheating step is used, an additional savings will be realized. In this era of concern for the expenditure of fuels, an energy saving of this magnitude is especially significant.

Variations and modifications of the above described method and apparatus may become apparent to one skilled in the art upon reading this disclosure, however, the breadth of the invention is not limited to the preferred embodiments disclosed above, but is defined by the scope of the appended claims.

We claim:

1. Apparatus for drying sheets of veneer comprising:

a drying chamber;

means for establishing a vacuum condition in said drying chamber;

at least one inlet opening into said chamber and at least one outlet opening from said chamber;

means for sealing said inlet and outlet openings to maintain the vacuum condition in said chamber;

means for continuously introducing a succession of veneer sheets individually through said inlet opening into said chamber while maintaining the vacuum condition therein;

conveyor means in said chamber for continuously moving veneer sheets from said inlet opening along a path through said chamber to said outlet opening;

at least two radiant infrared emitters in said chambers in spaced relation to said path for exposing each individual veneer sheet to radiant energy of the long wave infrared spectrum; at least one radiant infrared emitter being located on each of the opposite sides of said path so that substantially the entire face of both sides of each individual veneer sheet is exposed as the sheet moves along said path;

means for controlling the level of said radiation to which the sheets moving through said chmber are exposed to raise the surface temperature of said sheets to a level sufficient to dry said sheets but insufficient to result in damage thereto, and means for continuously withdrawing veneer sheets from said chamber through said outlet opening while maintaining the vacuum condition therein.

2. Apparatus according to claim 1 wherein said means for introducing veneer sheets comprises means for unstacking a stack of veneer sheets to be introduced into the chamber.

3. Apparatus according to claim 1 wherein said means for withdrawing veneer sheets comprises means for stacking the veneer sheets subsequent to withdrawing the sheets from the drying chamber.

4. Apparatus according to claim 1 comprising a plurality of separate, substantially parallel paths for veneer sheets through said drying chamber.

5. Apparatus according to claim 4 wherein said chamber has a plurality of inlets and a corresponding number of outlets, and said conveyor means provides a separate path between each inlet and an associated outlet.

6. Apparatus according to claim 1 further comprising means for preheating veneer sheets prior to introducing the sheets into the drying chamber.

7. Apparatus according to claim 6 wherein said preheating means comprises at least one gas infrared heater adjacent said means for introducing said veneer sheets into said drying chamber.

8. Apparatus according to claim 1 wherein the level of radiation to which the sheets are exposed is controlled to maintain the maximum surface temperature of the veneer sheets in the drying chamber less than 270° F.

9. Apparatus according to claim 1 wherein said means for controlling the radiation level comprises means for measuring the surface temperature of the veneer sheets in the drying chamber and means for controlling the radiation from the infrared emitters in accordance with the measured temperature value to maintain the surface temperature of the veneer sheets at a desired temperature value.

10. Apparatus according to claim 1 wherein said path is substantially linear.

11. The apparatus of claim 1 wherein said conveyor means comprises a plurality of spaced rollers supporting said sheets, whereby said sheets are exposed to said infrared radiation between said rollers.

12. The apparatus of claim 1 wherein said sealing means comprises a plurality of pairs of sealing rollers defining the top and bottom of each of said openings, each of said sealing rollers having a peripheral surface and a pair of end surfaces and being mounted such that their axes are substantially parallel to the walls of the chamber and said sealing rollers extend through the planes of said walls, said sealing rollers being in opposed relationship, at least one of said sealing rollers being biased toward the other of said sealing rollers, said sealing rollers being relatively movable with respect to one another between a closed position wherein said peripheral surfaces are in sealing engagement with one another and an open position wherein said sealing rollers are spaced apart and said peripheral surfaces are in sealing engagement with the upper and lower surfaces of a veneer sheet passing therebetween.

13. The apparatus of claim 12 wherein said sealing means further comprises opposed side seals mounted on said walls and defining the sides of each of said openings and being in slidable sealing engagement with and biased toward said side surfaces of said sealing rollers.

14. The apparatus of claim 12 further comprising first and second pairs of sealing rollers spaced vertically from one another so that the lower sealing roller of said first pair is adjacent to and spaced from the upper sealing roller of said second pair, and a plurality of front sealing members, each said front sealing member being positioned between said lower sealing roller of said first pair and said upper sealing roller of said second pair, each said front sealing member extending the full width of said sealing rollers and having a first sealing surface in slidable sealing engagement with the peripheral surface of said lower sealing roller of said first pair and a second sealing surface in slidable sealing engagement with the peripheral surface of said upper sealing roller of said second pair.

15. The apparatus of claim 14 wherein each said front sealing member is substantially wedge-shaped in cross-section, with the apex thereof extending between said lower sealing roller of said first pair and said upper sealing roller of said second pair.

16. The apparatus of claim 15 wherein each said front sealing member is mounted on a support attached to one of said walls, and is biased inwardly by spring means.

17. The apparatus of claim 15 wherein said sealing means further comprises a plurality of side seal means defining the sides of the said openings defined by adjacent pairs of sealing rollers, said side seal means being in slidable sealing engagement with and biased toward said side surfaces of said sealing rollers.

18. The apparatus of claim 17 wherein said pairs of sealing rolls are vertically aligned with one another, and wherein said side seal means comprises a first pair of opposed side seal members each having a side seal surface in sealing engagement with one side of all of said sealing rollers on said front wall and a second pair of opposed side seal members each having a side seal surface in sealing engagement with one side of all of said sealing rollers in said rear wall.

19. The apparatus of claim 17 wherein each said sealing member further comprises a pair of opposite end surfaces and further wherein each said side seal has a side sealing surface in sealing engagement also with said side surfaces of said sealing members.

20. The apparatus of claim 18 wherein said sealing surfaces of said sealing member and said side sealing surfaces of said side sealing members are of resilient material.

21. The apparatus of claim 20 wherein said peripheral surfaces of said sealing rollers are of resilient material.

22. The apparatus of claim 12 wherein each pair of sealing rollers comprises an upper sealing roller and a lower sealing roller, and wherein said lower sealing roller is mounted upon a lower roll shaft supported for rotation in fixed bearing means and is positively driven in rotation by driving means, and wherein said upper sealing roller is mounted upon an upper roller shaft vertically movably supported at each end in vertically oriented slots.

23. The apparatus of claim 1 further comprising separator means interposed between said vacuum means and said chamber for removing particles from the gas being drawn to said vacuum means.

* * * * *